US010196168B2

(12) United States Patent
Pierre

(10) Patent No.: US 10,196,168 B2
(45) Date of Patent: Feb. 5, 2019

(54) CONTAINER HAVING A BOTTOM PROVIDED WITH A STEPPED ARCH

(71) Applicant: SIDEL PARTICIPATIONS, Octeville sur Mer (FR)

(72) Inventor: Ivan Pierre, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 261 days.

(21) Appl. No.: 14/777,892

(22) PCT Filed: Mar. 31, 2014

(86) PCT No.: PCT/FR2014/050762
§ 371 (c)(1),
(2) Date: Sep. 17, 2015

(87) PCT Pub. No.: WO2014/162088
PCT Pub. Date: Oct. 9, 2014

(65) Prior Publication Data

US 2016/0288946 A1 Oct. 6, 2016

(30) Foreign Application Priority Data

Apr. 2, 2013 (FR) ..... 13 52976

(51) Int. Cl.
*B65D 1/42* (2006.01)
*B65D 1/02* (2006.01)

(52) U.S. Cl.
CPC ..... *B65D 1/0284* (2013.01); *B65D 1/0207* (2013.01); *B65D 2501/0018* (2013.01); *B65D 2501/0036* (2013.01)

(58) Field of Classification Search
CPC ..... B65D 1/0284
See application file for complete search history.

(56) References Cited

U.S. PATENT DOCUMENTS 4,249,666 A * 2/1981 Hubert ..... B65D 1/0276 215/373
5,381,910 A 1/1995 Sugiura et al.
2003/0052076 A1 3/2003 Cheng et al.
(Continued)

FOREIGN PATENT DOCUMENTS

FR 2 959 214 A1 3/1998
FR 2 753 435 A1 10/2011
WO 2011/157952 A1 12/2011

OTHER PUBLICATIONS

International Search Report, dated Jul. 7, 2014, from corresponding PCT application.

*Primary Examiner* — Stephen Castellano
(74) *Attorney, Agent, or Firm* — Young & Thompson

(57) ABSTRACT

A plastic container (1) is provided with a body (5) and a bottom (6) that extends from a lower end of the body (5), the bottom (6) including: a peripheral base (7) defining a bearing surface (8); a concave arch (10) that extends from a central zone (11) to the base (7); and a series of main reinforcing grooves (13) hollowed into the arch, extending radially from the central zone (11) at least to the base (7) and dividing the arch into a series of angular sectors (15). Where each groove (13) joins each sector (15) of the arch (10) adjacent thereto it is bordered laterally by a reinforcing rib (18) projecting in relation to the sector (15).

13 Claims, 2 Drawing Sheets

(56) References Cited

U.S. PATENT DOCUMENTS

| | | | | |
|---|---|---|---|---|
| 2003/0196926 | A1* | 10/2003 | Tobias | B65D 1/0284 206/509 |
| 2004/0094502 | A1* | 5/2004 | Boukobza | B65D 1/0284 215/375 |
| 2010/0297375 | A1* | 11/2010 | Protais | B65D 1/0284 428/36.92 |
| 2011/0309090 | A1 | 12/2011 | Derroem et al. | |
| 2013/0043209 | A1 | 2/2013 | Wurster et al. | |
| 2013/0043255 | A1 | 2/2013 | Boukobza | |
| 2013/0087568 | A1 | 4/2013 | Hermel et al. | |

* cited by examiner

CONTAINER HAVING A BOTTOM PROVIDED WITH A STEPPED ARCH

This application is the national stage (Rule 371) of international application PCT/FR2014/050762 filed Mar. 3, 2014.

The invention relates to the field of containers, particularly bottles or jars, manufactured by blow molding or stretch-blow molding from parisons of plastic material such as polyethylene terephthalate (PET).

BACKGROUND OF THE INVENTION

A container comprises, conventionally, a body that delimits the general volume of the container, extended, at an upper end of the container, by a neck, through which the container is filled and emptied, and, at a lower end, by a bottom that closes the container.

The bottom must be able to bear, without significantly deforming, at least the hydrostatic pressure of the column of liquid that is above it. Many shapes of bottoms exist, depending on the applications concerned. Thus, for carbonated applications (typically sodas), the bottoms generally have a petaloid shape, comprising an alternation of valleys, of hemispherical shape, and projecting feet, whose ends form a base for the container (see, for example, the French patent application FR 2 959 214 or its U.S. equivalent US 2013/043255).

The petaloid-shaped bottom appears as a relatively successful solution exhibiting a good resistance to the strong internal pressures in the container (thanks to the hemispherical shape of the valleys).

However, the petaloid-shaped bottom requires a considerable amount of material (on the order of 15 to 18 g for a 0.5 liter container), as well as a relatively high blow molding pressure, to ensure a proper impression-taking of the feet and valleys. These constraints appear justified, however, by the relatively high price at which the products concerned are distributed.

The petaloid-shaped bottoms, however, may not be suitable for flat-liquid-type applications (typically table water), for which the blow molding pressure and the amount of material used (today on the order of 10 g for a 0.5 liter container) are minimized.

A bottom provided with a simple concave arch is not able to support without significant deformation the hydrostatic pressure alone of the liquid that is above it. Therefore, it has been proposed to provide the bottom with radial ribs, intended to reinforce the bottom to make it possible for it to better withstand the deformations caused by the pressure of the contents.

Now, it is becoming common for certain applications of flat liquids that are susceptible to oxidation (particularly fruit juices, but also certain plain waters) to remove the air above the flat liquid and to replace it with an inert gas (typically nitrogen). In practice, this operation is performed by adding a drop of liquefied inert gas to the surface of the flat liquid, immediately preceding the capping of the container. This operation, referred to as inerting (nitrogenating in the case of nitrogen), causes an excess pressure in the container. Although seemingly slight (on the order of 0.5 to 1 bar), this excess pressure is enough to considerably increase the stresses that are exerted on the bottom.

It has been proposed by the applicant to improve the ribbed bottoms by introducing a variability in the depth of the grooves, see, for example, French patent FR 2 753 435 (Sidel), to make it possible for the bottom to offer enough mechanical strength to bear the excess pressure due to nitrogenating. However, the savings demands of the market, or even certain anti-pollution standards, lead the manufacturers to use ever less material. Other things being equal, the result is a reduction in the mechanical performance of the bottom. This is particularly the case of the bottom described in the aforementioned patent, such that it consequently appears necessary to enhance it to maintain, indeed improve, its performance without, however, adversely affecting its blowability (i.e., its ability to be properly shaped by blow molding).

SUMMARY OF THE INVENTION

For this purpose, a container made of plastic material is proposed that is provided with a body and with a bottom extending from a lower end of the body, the bottom comprising:

- a peripheral base defining a standing plane;
- a concave arch that extends from a central area to the base;
- a series of main reinforcing grooves, formed recessed in the arch, which extend radially from the central area to the base at least, and which subdivide the arch in a series of angular sectors, each main groove being bordered laterally, at its junction with each sector of the arch that is adjacent to it, by a reinforcing rib that extends projecting in relation to said sector.

Provided with a thus structured bottom, the container offers a better mechanical performance than the standard grooved bottoms with an equal amount of material, while offering a good blowability.

Various additional characteristics can be foreseen, alone or in combination:

- each main groove exhibits a bottom flanked by two lateral walls, and in that each reinforcing rib extends into the extension of a lateral wall.
- each rib extends inwardly to the central area.
- the bottom comprises an annular ledge that extends approximately perpendicular to the standing plane and forms the junction between it and a peripheral edge of the arch.
- each rib extends outwardly to the standing plane.
- at its junction with the standing plane, each rib lies flush with it.
- the ribs located on both sides of the same angular sector extend into the continuity of one another.
- the bottom has, on the inside of the standing plane, two concentric regions, namely a central region and a peripheral region, separated by a median axial step that extends annularly in a continuous manner, at the same time on the angular sectors, the main grooves and the ribs, around the central area, such that the central region is offset axially in relation to the peripheral region toward the interior of the container.
- the main reinforcing grooves extend radially beyond the base.
- the bottom comprises a series of intermediate reinforcing grooves, which extend locally astride the base.

BRIEF DESCRIPTION OF THE DRAWINGS

Other objects and advantages of the invention will come to light from the description of an embodiment, given hereafter with reference to the accompanying drawings in which.

DETAILED DESCRIPTION OF THE PREFERRED EMBODIMENTS

Figure 1:
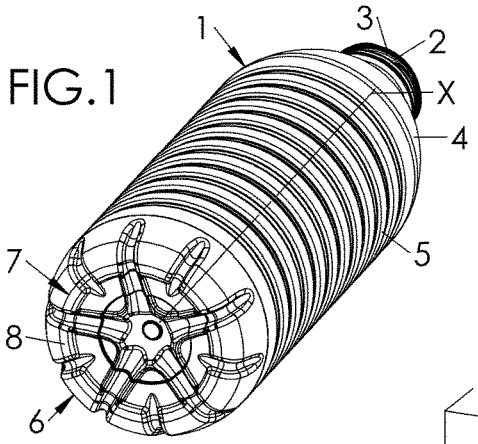
FIG. 1 is a bottom perspective view of a container made of plastic material.
Figure 1:
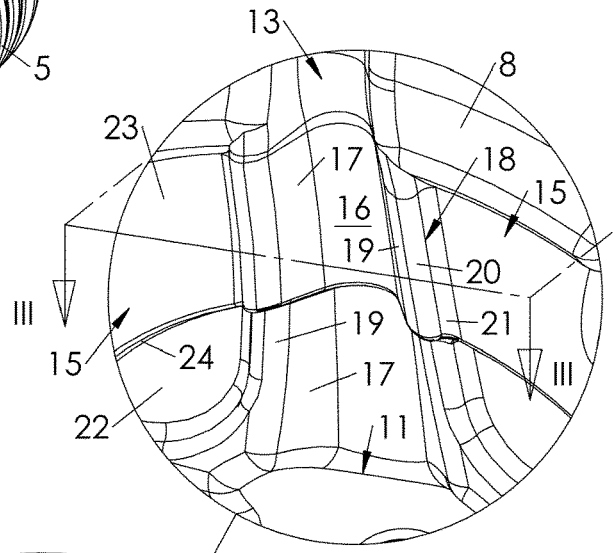

In FIG. 1, a container 1 is shown, in this particular case a bottle, made by stretch-blow molding from a preform of thermoplastic material, for example of PET (polyethylene terephthalate).

This container 1 comprises, at an upper end, a neck 2, provided with a rim 3. In the extension of the neck 2, the container 1 comprises, in its upper part, a shoulder 4 that flares out in the direction opposite the neck 2, this shoulder 4 being extended by a lateral wall or body 5, with a generally rotationally cylindrical shape around a main axis X of the container 1.

The container 1 further comprises a bottom 6 that extends opposite the neck 2, from a lower end of the body 5. The bottom 6 of the container comprises a peripheral base 7 in the form of an annular pad that extends approximately axially in the extension of the body 5. The base 7 defines a standing plane 8 perpendicular to the longitudinal axis X of the container 1, which standing plane 8 forms the lower end of the container 1 and makes it possible for it to be set, standing, on a flat surface.

Toward the interior of the container 1, the base 7 comprises a truncated, cone-shaped, annular ledge 9 that extends toward the interior of the container 1 in the extension of the standing plane 8, the truncated cone formed by the ledge 9 opening downward (in relief) and having an angle at the apex of at least 70° (and less than or equal to 90°). This ledge 9 can have a height of between 1 mm and 3 mm, for example about 1.5 mm.

The bottom 6 of the container further comprises a concave arch 10, in the shape of an approximately spherical dome that is concave and facing toward the exterior of the container 1 in the absence of stress, i.e., in the absence of contents in the container 1. The arch 10 extends from the base 7, in the extension of the ledge 9 (which forms a junction between the standing plane 8 and a peripheral edge of the arch 10), to a central area 11 of the bottom 6 forming a piece projecting toward the interior of the container 1, with—at its center—an amorphous button 12 that corresponds to the injection area of the constituent material of the preform that has been used to make the container 1 and can fulfill the function of centering during the forming, by blow molding, of the container 1.

Figure 2:
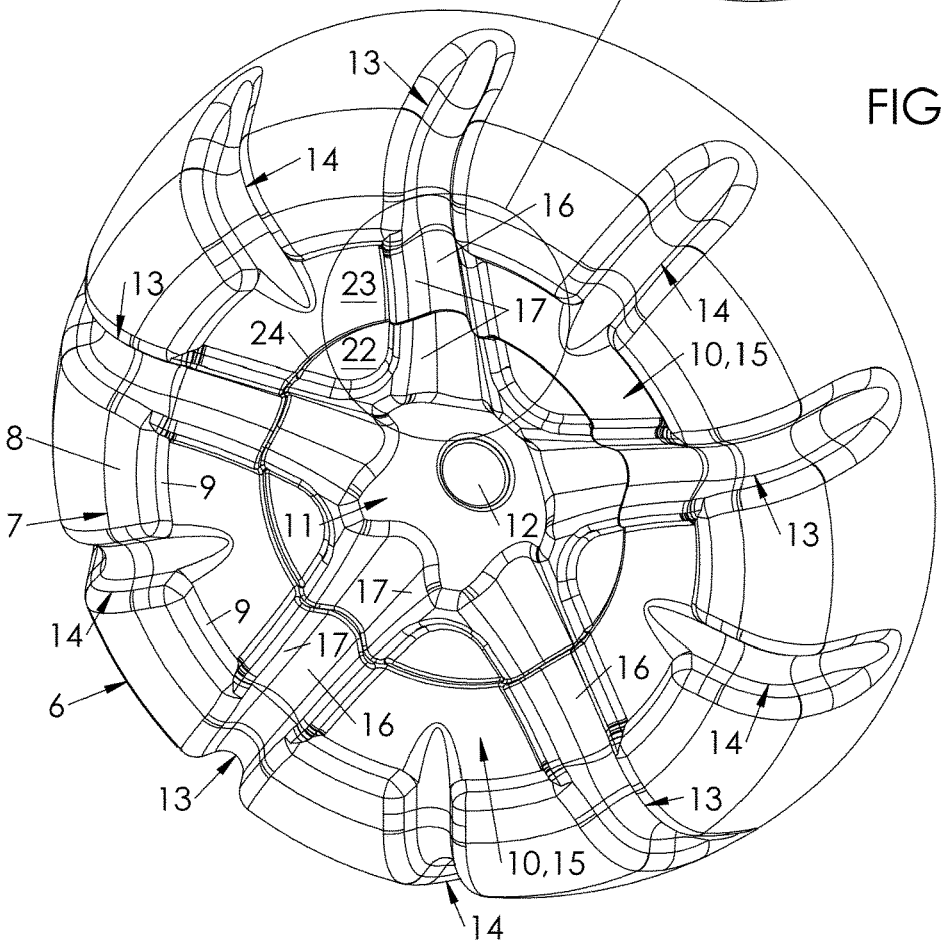
FIG. 2 is a perspective view, on an enlarged scale, showing the bottom of the container of FIG. 1 with, in an inset, a detail in still larger scale.

As can be seen in the figures, and in particular in FIG. 2, the bottom 6 of the container comprises a series of main reinforcing grooves 13 formed recessed in the arch 10 toward the interior of the container 1, which extend radially from the central area 11, to the base 7 at least. In the example of embodiment illustrated in the figures, the main reinforcing grooves 13 extend radially beyond the base 7, rising laterally on a lower part of the body 5. The grooves thus form jointly a reinforcing star-shaped structure of the bottom of the container.

In other words, the main grooves 13 extend radially over the whole arch 10, straddling the base 7 and partially the body 5. Consequently, it is understood that the standing plane 8 is discontinuous, since it is interrupted at right angles to each main groove 13. The main grooves 13 are, for example, five in number (as in the illustrated example, which corresponds to a container with a capacity of 0.5 liter), but this number could be greater, particularly six in the case of a container with a capacity that is greater than or equal to 1 liter, or even seven in the case of a container with a capacity that is greater than or equal to 2.5 liters.

Figure 3:
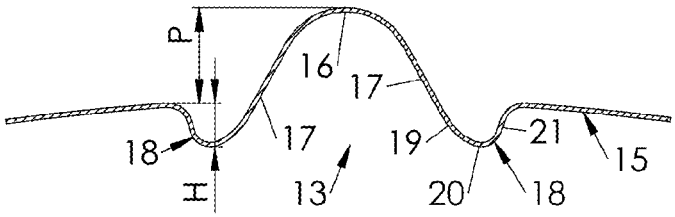
FIG. 3 is a cutaway detail view of the bottom illustrated in FIG. 2, along the cutting plane III-III.

According to a preferred embodiment, the bottom 6 of the container is further provided with a series of intermediate reinforcing grooves 14, located between the main grooves 13, and which extend locally astride the base 7 that they thus contribute to making rigid. As shown in FIGS. 2 and 3, the intermediate grooves 14 extend toward the exterior beyond the base 7 by rising laterally on a lower part of the body 5, like the main grooves 13. In the example illustrated in FIG. 2, the intermediate grooves 14 straddle the ledge 9 but are interrupted at the periphery of the arch 10.

The main grooves 13 have the function of increasing the resistance of the arch 10 to collapsing (indeed to inversion) under the effect of the forces caused by the pressure exerted by the contents of the container 1 (typically a flat liquid optionally put under pressure by the injection of a drop of liquefied gas into the volume defined in the neck 2 between the open surface of the liquid and the rim 3, immediately before the capping of the container 1).

As illustrated in FIG. 2, the main grooves 13 subdivide the arch 10 into a series of approximately triangular-shaped angular sectors 15.

Each main reinforcing groove 13 has a bottom 16 that extends from the central area 11 in a radial direction, flanked by two lateral walls 17. The depth of the groove 13, measured between the edge of the angular sectors 15 that are adjacent to the groove 13, and its bottom 16, is marked P.

In a preferred example of embodiment, the bottom 16 of the groove 13 exhibits in cross-section a rounded profile (which could, however, be flattened), the lateral walls 17 defining in cross-section an open angle, such that the groove 13 has a V-shaped section with a rounded tip.

Figure 4:
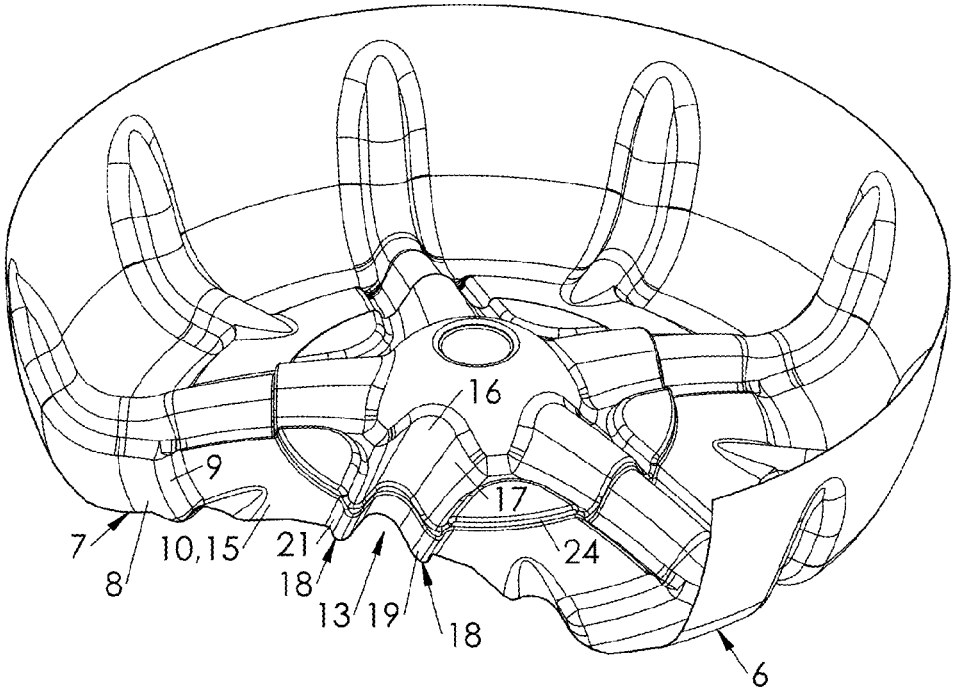
FIG. 4 is a perspective view, in partial cutaway, of the bottom of FIG. 2.

As is seen clearly in FIGS. 2 to 4, each main groove 13 is bordered laterally (i.e., on both sides along the radial direction of extension of the groove 13) by a reinforcing rib 18 that extends projecting in relation to the adjacent angular sector 15, at the junction between the groove 13 and the sector 15.

Each reinforcing rib 18 has the function of forming a reinforcing beam (or stiffener) that acts like a strut and that is intended to increase the resistance of the bottom 6 of the container to deformations due to the pressure exerted by the contents of the container 1. In particular, the reinforcing ribs 18 aim to minimize the risks of inversion of the bottom 6 (and more specifically of the arch 10) under the effect of too great an internal pressure in the container 1.

According to a preferred embodiment, each reinforcing rib 18 makes a continuous junction between the main groove 13 that it borders and the arch 10. More specifically, and as is illustrated in FIG. 3, each reinforcing rib 18 has an inner section 19, which extends in the lengthening of the lateral wall 17 to a crest line 20 that forms an apex of the rib 18, and an outer section 21 that ensures the junction with the adjacent angular sector 15. The height of the rib 18, measured between the edge of the adjacent angular sector 15 and the crest line 20, is marked H. This height H is preferably greater than or equal to half the depth of the main groove 13:

$$H \geq \frac{P}{2}$$

As is seen in FIG. 2, each reinforcing rib 18 extends inward to the central area 11 and outward to the standing plane 8. More specifically, each rib 18 is anchored in the ledge 9 lying flush with the standing plane 8 at its junction with it. In this way, the rib 18 forms no excess thickness in relation to the standing plane, for the benefit of the stability of the container 1.

As in the illustrated example, the reinforcing ribs 18 that border two adjacent main grooves 13, located on both sides of the same angular sector 15 of the arch 10, preferably extend in continuity with one another, implementing their junction in the vicinity of the central area 11 and together forming a continuous V-shaped reinforcing structure.

In this way, each angular sector 15 of the arch 10 is bordered outwardly by the ledge 9, and laterally and inwardly by two adjacent and contiguous reinforcing ribs 18.

Thus, each main groove 13 extends projecting, in relation to each sector of the arch 10, toward the interior of the container 1, while each reinforcing rib 18 extends projecting, in relation to the angular sector 15, toward the exterior of the container 1. The result is a relative non-deformability of the bottom 6 of the container to the deformations due both to an excess pressure in the container 1 (having a tendency to push the bottom 6 back toward the exterior of the container 1) and to a negative pressure in it (having a tendency to draw the bottom 6 toward the interior of the container 1), following, for example, a cooling. Overall, the bottom of the container that is structured in this way offers a better resistance to deformation than an ordinary bottom, having an equal amount of material.

As is seen in the figures, and more clearly in FIGS. 2 and 4, the bottom 6 of the container can also have two concentric regions, namely an annular central region 22 surrounding the central area 11 of the bottom 6, and an annular peripheral region 23 surrounding the central region 22, separated by a step 24 that extends axially over a predetermined height. This step 24 is median in relation to the arch 10, i.e., the central region 22 and the peripheral region 23 exhibit approximately the same radial extension.

The step 24 extends continuously, i.e., it is interrupted neither on a level with the main grooves 13 but extends to the bottom 16 of them, nor on a level with the reinforcing ribs 18 but extends straddling them.

The axial step 24 extends annularly around the central area 11. In the embodiment shown, where the container 1 has an approximately rotationally cylindrical shape around its axis X, the step 24 forms a ring having a circular contour.

By the presence of the axial step 24, the central region 22 of the bottom 6 of the container, although having a radius of curvature that is approximately identical to that of the peripheral region 23, is found to be slightly offset in relation to it toward the interior of the container 1.

The step 24 has the function of maintaining the stability of the container 1 by causing a stiffening of the arch 10 in its median region and by limiting the deformation of the arch 10 so as to enlarge the base 7 toward the center of the bottom 6 of the container.

Thus, a container 1 of PET as described previously, with a capacity of 0.5 liter, with a weight of 10 g, has been able to be blow molded without difficulty at an air pressure of about 20 bar, the final container 1 filled with plain water offering good mechanical performance including under a condition of excess pressure due to nitrogenating in the area of the neck 2.

The container 1 provided with this bottom 6 exhibits a good compromise between mechanical performance (i.e., the capacity of the container 1 to withstand deformations and, when they occur, to endure them in a controlled manner) and blowability (i.e., the capacity of the container 1 to be formed by blow molding).

The invention claimed is:

1. A container (1) made of plastic material, provided with a body (5) and with a bottom (6) extending from a lower end of the body (5), the bottom (6) comprising:

a peripheral base (7) defining a standing plane (8);

a concave arch (10) that extends from a central area (11) to the base (7); and a series of main reinforcing grooves (13), formed recessed in the arch, which extend radially from the central area (11) to the base (7) at least, and which subdivide the arch into a series of angular sectors (15), wherein each main groove (13) is bordered laterally, at a junction of the groove with each angular sector (15) of the arch (10) that is adjacent thereto, by a reinforcing rib (18) that extends projecting in relation to said angular sector (15), and wherein each main groove (13) has a groove bottom (16) flanked by two lateral walls (17), and each reinforcing rib (18) extends into an extension of one of said lateral wall (17), and wherein each reinforcing rib (18) is formed of an inner section (19) extending into the extension of an adjacent lateral wall, and an outer section (21) opposite the inner section (19), a crest line (20) of the reinforcing rib (18) formed at a junction between the inner section (19) and the outer section (21), the outer section (21) located at the junction to an adjacent angular sector.

2. The container (1) according to claim 1, wherein each reinforcing rib (18) extends inwardly to the central area (11).

3. The container (1) according to claim 1, wherein the bottom (6) of the container comprises a plurality of ledge portions (9) located between the main grooves and running along an annular path that surrounds the arch (10), the ledge portions (9) each including a portion that extends approximately perpendicular to the standing plane (8) and forms a junction between the standing plane (8) and a peripheral edge of the arch (10).

4. The container (1) according to claim 1, wherein each reinforcing rib (18) extends outwardly to the standing plane (8).

5. The container (1) according to claim 3, wherein each reinforcing rib lies flush with the standing plane (8) at its junction with the standing plane.

6. The container (1) according to claim 1, wherein the reinforcing ribs (18) located on both sides of the same angular sector (15) extend into the continuity of one another.

7. The container (1) according to claim 1, wherein the bottom (6) of the container has, on the inside of the standing plane (8), two concentric regions, namely a central region (22) and a peripheral region (23), separated by a median axial step (24) that extends annularly in a continuous manner, at the same time on the angular sectors (15) of the arch (10), the main grooves (13) and the reinforcing ribs (18), around the central area (11), such that the central region (22) is offset axially in relation to the peripheral region (23) toward the interior of the container (1).

8. The container (1) according to claim 1, wherein the main reinforcing grooves (13) extend radially beyond the base (7).

9. The container (1) according to claim 1, wherein the bottom (6) of the container comprises a series of intermediate reinforcing grooves (14), which extend locally astride the base (7).

10. The container (1) according to claim 2, wherein the bottom (6) of the container comprises a plurality of ledge portions (9) located between the main grooves and running along an annular path that surrounds the arch (10), the ledge portions (9) each including a portion that extends approximately perpendicular to the standing plane (8) and forms a junction between the standing plane (8) and a peripheral edge of the arch (10).

11. The container (1) according to claim 2, wherein each reinforcing rib (18) extends outwardly to the standing plane (8).

12. The container (1) according to claim 3, wherein each reinforcing rib (18) extends outwardly to the standing plane (8).

13. The container (1) according to claim 1, wherein a height of the reinforcing rib (18) measured between an edge of the adjacent angular sector and the crest line (20) of the reinforcing rib (18) is equal to or greater than half the depth of the main groove (13).

* * * * *